US009681760B1

(12) United States Patent
Longberg

(10) Patent No.: US 9,681,760 B1
(45) Date of Patent: Jun. 20, 2017

(54) HANG TAB WITH MULTIPLE POSITIONS

(71) Applicant: Wynalda Litho, Inc., Belmont, MI (US)

(72) Inventor: Daniel Paul Longberg, Rockford, MI (US)

(73) Assignee: Wynalda Litho, Inc., Belmont, MI (US)

( * ) Notice: Subject to any disclaimer, the term of this patent is extended or adjusted under 35 U.S.C. 154(b) by 0 days.

(21) Appl. No.: 15/145,677

(22) Filed: May 3, 2016

Related U.S. Application Data

(60) Provisional application No. 62/279,238, filed on Jan. 15, 2016.

(51) Int. Cl.
*A47F 5/00* (2006.01)
*B65D 73/00* (2006.01)

(52) U.S. Cl.
CPC ..... *A47F 5/0006* (2013.01); *B65D 73/0064* (2013.01)

(58) Field of Classification Search
CPC ..... B65D 25/22
See application file for complete search history.

(56) References Cited

U.S. PATENT DOCUMENTS

| | | | | |
|---|---|---|---|---|
| 5,509,528 | A | 4/1996 | Weisburn | |
| 7,128,222 | B2 | 10/2006 | Doucette | |
| 7,137,513 | B2 * | 11/2006 | Sedon | A47F 7/0246 211/116 |
| 7,413,080 | B2 * | 8/2008 | Van House | B65D 75/52 206/45.2 |
| 8,418,858 | B2 | 4/2013 | Foltz et al. | |
| 9,133,649 | B2 | 9/2015 | Taylor et al. | |
| 2004/0182801 | A1 | 9/2004 | Sedon et al. | |
| 2009/0283556 | A1 | 11/2009 | Ho | |

* cited by examiner

*Primary Examiner* — Amy Sterling
(74) *Attorney, Agent, or Firm* — Zollinger & Burleson Ltd.

(57) ABSTRACT

A hang tab can be configured into a plurality of different positions that allow the merchandise with which it is used to be display in different configurations. The hang tab can be configured in an extended position for hanging the merchandise and a collapsed position wherein the merchandise is going to be placed on a shelf. In one configuration, the hang tab includes a body defined by a hook portion and a base portion. The hook portion is pivotably mounted to the base portion. One of the hook and base portion includes at least one locking tab with the other of the hook and base portion defining at least one locking recess. When the locking tab is received in the locking recess, the position of the hang tab is fixed with the locking tab in the extended position that allows the hang tab to hang from a hook.

23 Claims, 7 Drawing Sheets

HANG TAB WITH MULTIPLE POSITIONS

CROSS REFERENCE TO RELATED APPLICATIONS

This application claims the benefit of U.S. Provisional Patent Application Ser. No. 62/279,238 filed Jan. 15, 2016; the disclosures of which are incorporated herein by reference.

BACKGROUND INFORMATION

1. Technical Field

The disclosure generally relates to devices used to display merchandise for viewing by potential consumers and, more particularly, to hang tabs used to hang merchandise directly or merchandise carried in storage containers. Specifically, the disclosure relates to a hang tab that can be configured for hanging and then collapsed if the merchant elects to place the merchandise on a shelf.

2. Background Information

Different items of merchandise are often displayed at retail locations in a hanging configuration from a hook. One common configuration is for a plurality of the same items of merchandise to be hung from a common elongated hook. The elongated hook is disposed through an opening defined by a portion of the merchandise storage container or by a hook connected to the merchandise storage container. At times, a merchant wants to move hanging merchandise from hooks to a shelf. When the hang tabs extend up from the top of the merchandise containers the containers take up more shelf space because of the shelf space consumed by the hang tabs. The merchant desires a hang tab that allows for both display configurations.

SUMMARY OF THE DISCLOSURE

The disclosure provides a hang tab that can be configured into a plurality of different positions that allow the merchandise with which it is used to be displayed in different configurations. The hang tab can be configured in an extended position for hanging the merchandise and a collapsed position wherein the merchandise is going to be placed on a shelf. The hang tab can be locked in either position. The hang tab can be repeatedly configured in these two positions as needed by the merchant. The hang tab can be separated from the merchandise upon sale of the merchandise and the hang tab can be re-used on different merchandise.

In one configuration, the hang tab includes a body defined by a hook portion and a base portion. The hook portion is pivotably mounted to the base portion. One of the hook and base portion includes at least one locking tab with the other of the hook and base portion defining at least one locking recess. The hook portion can be pivoted to a position where the locking tab is snap fit into the locking recess. When the locking tab is received in the locking recess, the configuration of the hang tab is fixed with the locking tab being received in the locking recess to hold the body in a first configuration.

In one configuration, the hang tab includes a body defined by a hook portion and a base portion. The hook portion is pivotably mounted to the base portion. The configuration of the pivotable configuration provides at least one configuration wherein the position of the hook portion is retained. The hook portion can be retained through the engagement of the fingers on a pivot bar or through the engagement of a locking tab in a locking recess.

The disclosure provides a configuration wherein the two portions of the body are injection molded from a polymer.

The disclosure provides a configuration wherein the base portion of the body is configured to be mounted to a merchandise storage container with an adhesive or can be mounted with a portion of the base portion disposed inside the merchandise storage container with another portion of the base portion protruding through the container.

The disclosure provides a locking configuration for the two portions of the body that is built into the configuration of the fingers and bars or as an extending locking tab. Both of these configurations minimizes the potential for a user's finger to be pinched during locking of the body. The locking tab is positioned between the fingers to minimize access and thus to minimize the potential of pinching.

BRIEF DESCRIPTION OF THE DRAWINGS

Similar numbers refer to similar parts throughout the specification.

DETAILED DESCRIPTION OF THE DISCLOSURE

Figure 1:
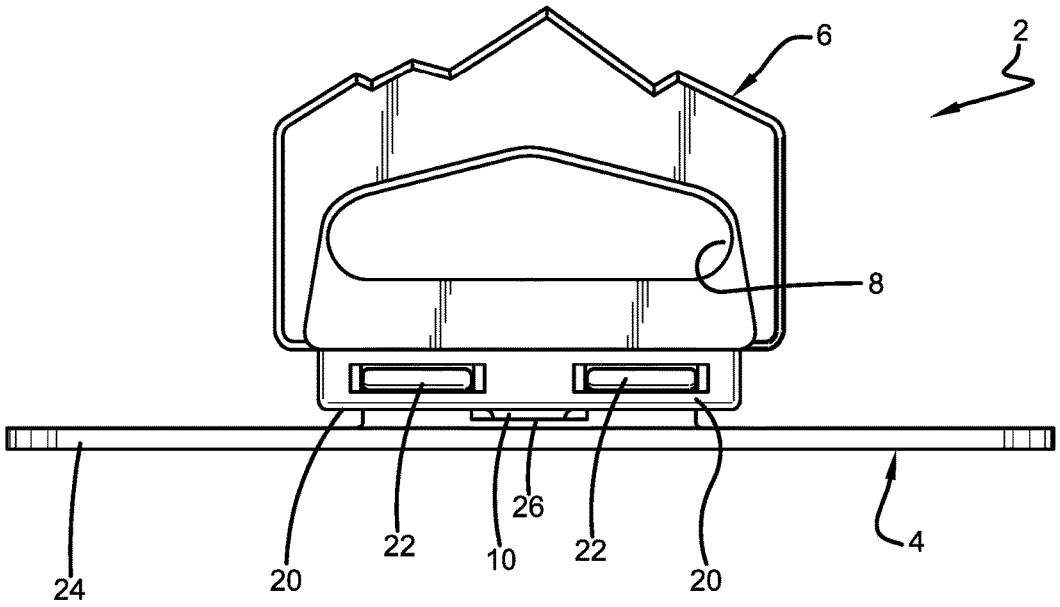
FIG. 1 is a front view depicting the hang tab in the extended position.

An exemplary configuration of a hang tab is indicated generally by the numeral 2 in the accompany drawings. Hang tab 2 generally includes a base portion 4 and a hook portion 6. Hook portion 6 is selectively connectable to base portion 4 such that it can be removed. Hook portion 6 is selectively positionable between extended and collapsed positions and can be locked in one or both of these conditions. Although the exemplary configuration of the hang tab has a hook portion 6 with an enclosed, surrounded through hole 8, hook portion 6 can also be provided in the form of a hanger hook with an open side so that hang tab 2 does not have to be placed over the end of a display rod. Through hole 8 is wide enough to receive side-by-side double hooks and defines a peak so that it is self-centering on a single hook. Hook portion 6 and base portion 4 are formed from a polymer and can be injection molded. Base portion 4 can be connected directly to an item of merchandise or can be connected to a merchandise storage container that holds the merchandise. When connected to a merchandise storage container, base portion 4 can be connected to the outside of the container with an adhesive or base portion 4 can be positioned inside the container or under a panel of the container with portions of the base portion extending out through an opening.

Figure 2:
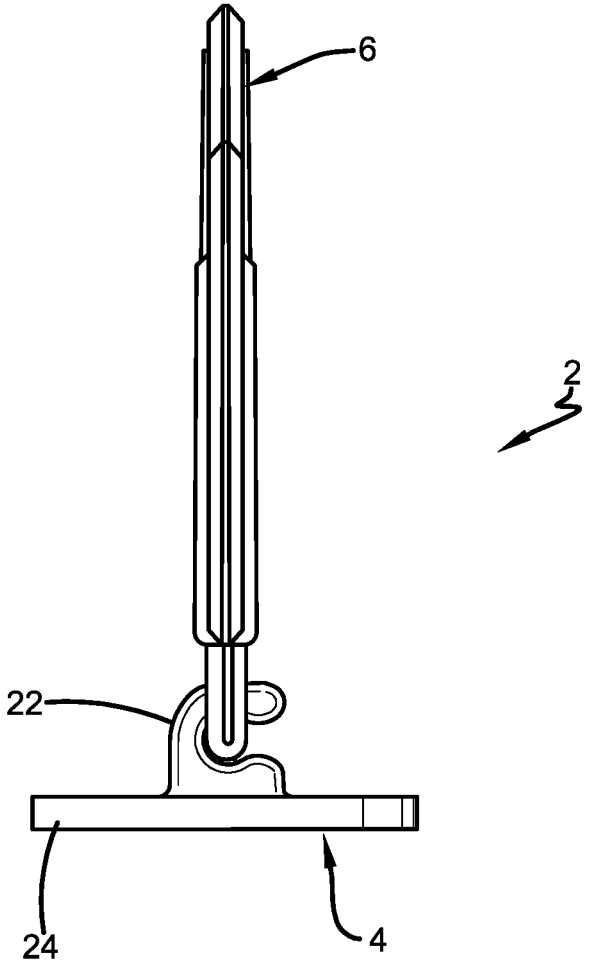
FIG. 2 is a side view of FIG. 1.
Figure 3:
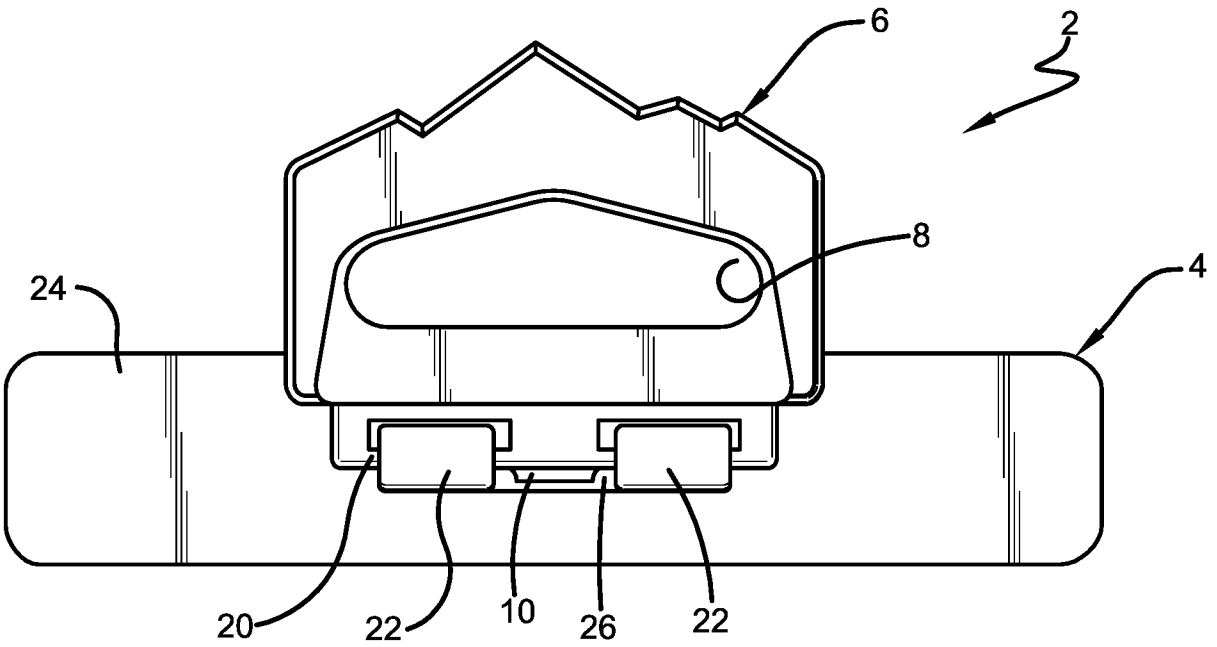
FIG. 3 is a top view depicting the hang tab in the collapsed position.
Figure 4:
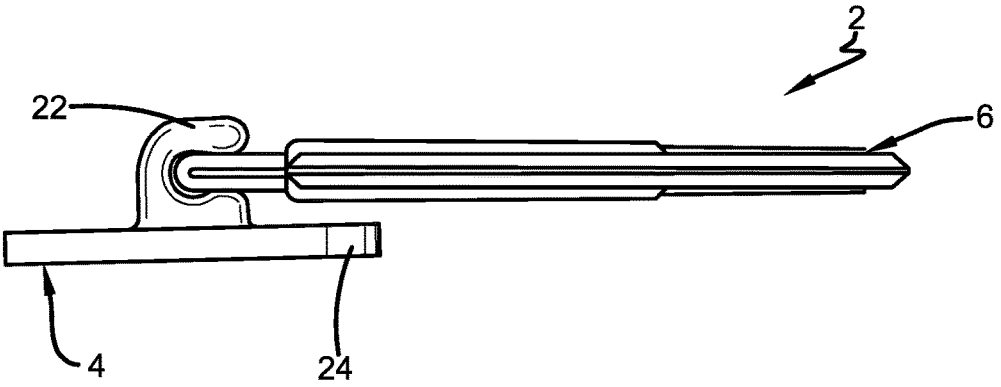
FIG. 4 is a side view of FIG. 3.
Figure 8:
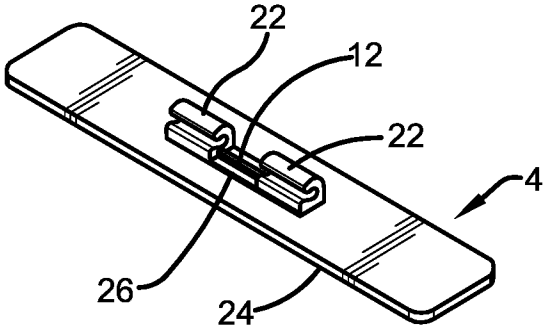
FIG. 8 is a perspective view of the base portion of the body.
Figure 7:
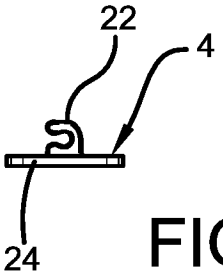
FIG. 7 is a side view of FIG. 6.
Figure 5:
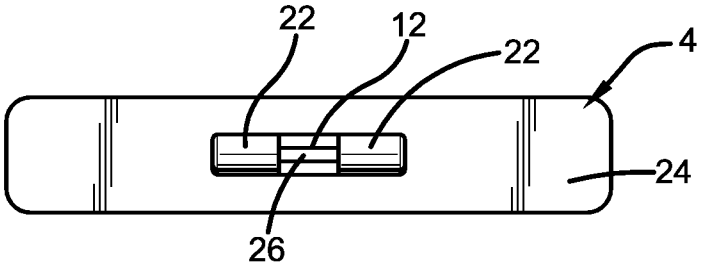
FIG. 5 is a top plan view of the base portion of the body.
Figure 6:
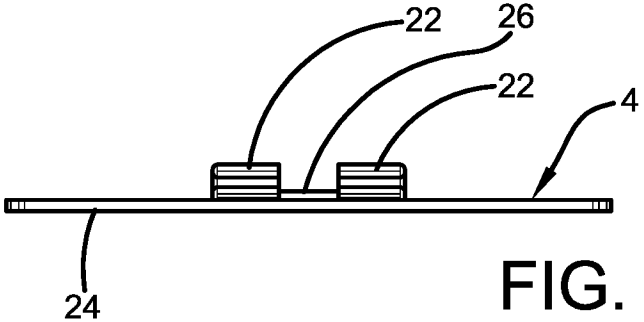
FIG. 6 is a front elevation view of the base portion of the body.
Figure 12:
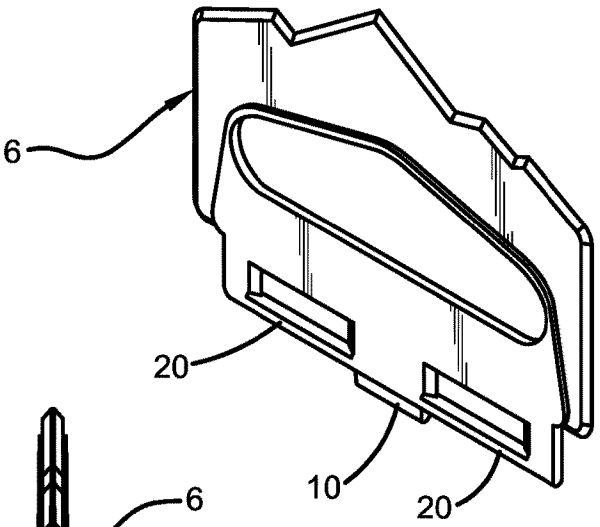
FIG. 12 is a perspective view of the hook portion of the body.
Figure 11:
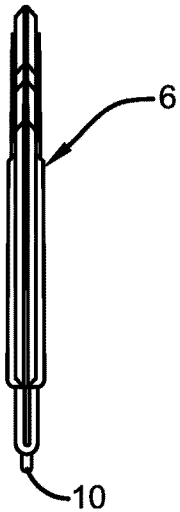
FIG. 11 is a side view of FIG. 10.
Figure 9:
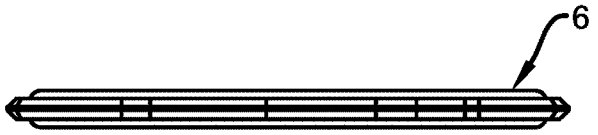
FIG. 9 is a top plan view of the hook portion of the body.
Figure 10:
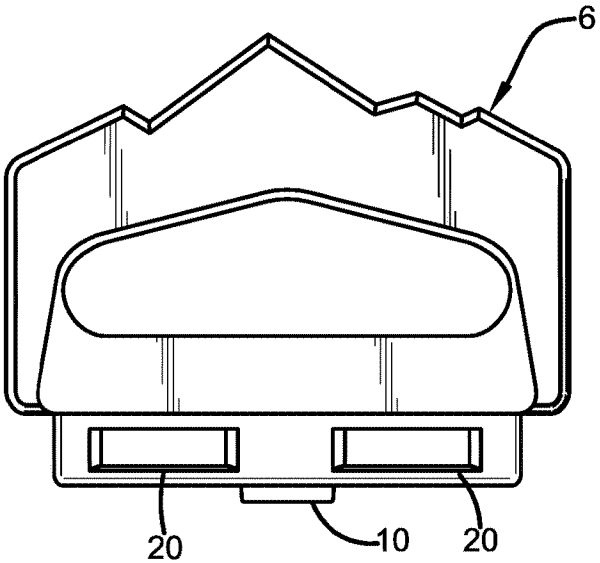
FIG. 10 is a front elevation view of the hook portion of the body.
Figure 13:
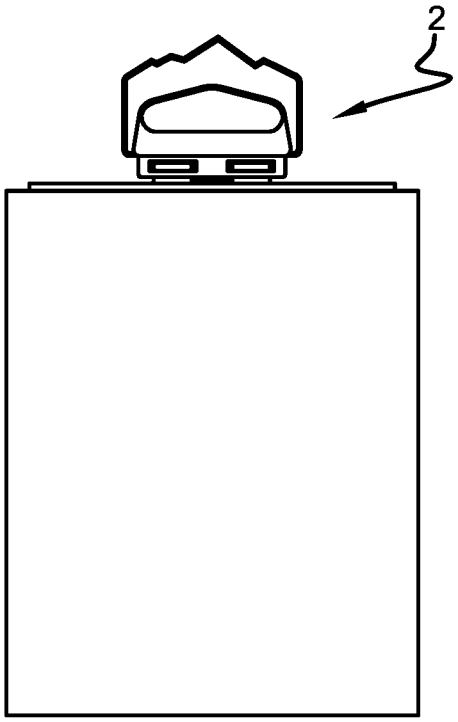
FIG. 13 is a view of an extended hang tab connected to a merchandise storage container in an extended position.
Figure 14:
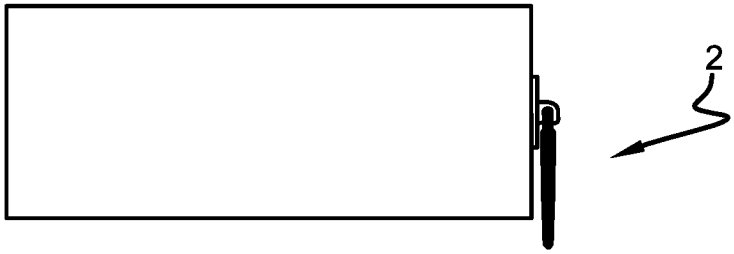
FIG. 14 is a view of a collapsed hang tab connected to a merchandise storage container in the collapsed position.

FIGS. 1 and 2 depict the extended position of hang tab 2. In this exemplary configuration, a locking tab 10 extends from hook portion 6 and is received within a locking recess 12 defined by base portion 4 to hold hook portion 6 in the extended position depicted in FIGS. 1 and 2. Locking tab 10 is received within locking recess 12 in a snap fit connection that allows the user to repeatedly make and break the connection by forcefully pivoting hook portion 6 with respect to base portion 4. In this context, the snap fit connection generally means that one part defines a protrusion that is deflected briefly during the making of the connection and then catches in a depression defined by the mating part. In one configuration, the protrusion returns to its stress free condition. In another configuration, the protrusion remains at least somewhat stressed while engaged. These snap fits can be cantilever, torsional, annular, rotational, or U-shaped. The strength of the snap fit connection can be varied depending on the application for hang tab 2. In the exemplary configuration, locking tab 10 extends from body portion 6. Locking tab 10 is thinner than hook portion 6 as shown in FIG. 11. In another configuration, locking tab 10 extends from base portion 4 and locking recess 12 is defined by hook portion 6. In another configuration, a pair of locking tabs 10 are used to hold hook portion 6 in each of the extended and collapsed positions. In another configuration, a plurality of locking tabs 10 extend from one of base portion 4 and hook portion 6 and lock hang tab 2 in each of a plurality of different positions.

Base portion 4 and hook portion 6 connect together in a pivotable connection formed between a pivot bar 20 defined by one of base portion 4 and hook portion 6 and a finger 22 connected to the other of the base portion 4 and the hook portion 6. In the exemplary configuration, base portion 4 includes two fingers 22 disposed on opposite sides of locking recess 12. Hook portion 6 provides a separate pivot bar 20 for each finger 22. Fingers 22 extend up from a generally flat mount 24. A boss 26 is disposed between fingers 22 and defines locking recess 12. This configuration allows hook portion 6 to pivot out of the extended position in both directions with respect to base portion 4. Once in the collapsed position, locking tab 10 maintains hook portion 6 in the collapsed position by being engaged with boss 26 and preventing hook portion 6 from moving to the extended position without being subjected to enough force to form the snap fit connection.

Each finger 22 is configured to receive a pivot bar 20 in a snap fit connection that allows pivot bar 20 and hook portion 6 to pivot while retained by finger 22. The pivoting motion is unrestrained except by locking tab 10. In one configuration, pivot bar 20 is resiliently held or frictionally held by finger 22. In one configuration, pivot bar 20 has a non-circular cross section that cooperates with finger 22 to define at least two positions for hook portion 6 as hook portion 6 pivots with respect to base portion 4. For example, pivot bar 20 can be oval in cross section with finger 22 defining an opening with four recesses to allow pivot bar 20 to snap into two locations defined by the four recesses. This feature can be used in combination with or as an alternative to locking tab 10 and recess 12.

Hang tab 2 is moved to the extended position when the user wishes to hang the merchandise from a hanger. In the extended position, hook portion 6 is substantially perpendicular to flat mount 24. In the situation where the user wants to take the merchandise off of the hanger and place the merchandise on a shelf, the user can change the configuration of hang tab 2 from the extended position to the collapsed position to reduce the shelf space required to display the merchandise. When collapsed, hook portion 6 can be moved to a position about ninety degrees from the extended position. Other collapsed configurations are possible depending on the configuration of the merchandise or merchandise storage container or the configuration of locking tab 10 and recess 12. For example, recess 12 and locking tab 10 can hold hook portion 6 in a forty-five degree configuration with respect to flat mount 24.

When the merchandise is sold, hang tab 2 can be sold with the merchandise or removed and reused. When hang tab 2 is used with a merchandise storage container, flat mount can be disposed under a slot defined by a portion of the storage container. This portion of the storage container can be moved to an open configuration to allow base portion 4 to be removed. For example, base portion 4 can be disposed under a flap of the merchandise storage container with the flap defined a slot that allows fingers 22 extending through the slot. Alternatively, this portion of the storage container can be configured to allow base portion 4 to be pulled through the slot. During this process, the slot can be enlarged to allow base portion 4 to be removed. The enlargement can be achieved by tearing a portion of the storage container to enlarge the slot.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the above description and attached illustrations are an example and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. A merchandise hang tab comprising:

a body having a hook portion and a base portion;

the hook portion being pivotably mounted to the base portion;

one of the hook and base portions including at least one locking tab with the other of the hook and base portions defining at least one locking recess;

the hook portion being retained in a first position with respect to the base portion when the locking tab is received in the locking recess; and wherein the hook portion and base portion are pivotably mounted together through the engagement of a pivot bar and a finger.

2. The merchandise hang tab of claim 1, wherein the hook portion defines a surrounded through hole.

3. The merchandise hang tab of claim 1, wherein the base portion includes a flat mount; the flat mount being adapted to be connected to an item of merchandise.

4. A merchandise hang tab comprising:

a body having a hook portion and a base portion;

the hook portion being pivotably mounted to the base portion;

one of the hook and base portions including at least one locking tab with the other of the hook and base portions defining at least one locking recess;

the hook portion being retained in a first position with respect to the base portion when the locking tab is received in the locking recess; and wherein the base portion includes a pair of fingers and the hook portion includes a pivot bar for each of the fingers; one pivot bar being releasably engaged by one of the fingers.

5. The merchandise hang tab of claim 4, wherein the base portion defines the locking recess between the pair of fingers.

6. The merchandise hang tab of claim 5, wherein the base portion includes a boss that defines the locking recess.

7. The merchandise hang tab of claim 6, wherein the boss extends between and is connected to the pair of fingers.

8. The merchandise hang tab of claim 1, wherein the locking tab has a thickness that is less than a thickness of the hook portion.

9. The merchandise hang tab of claim 1, wherein the locking tab is received in the locking recess in a makeable and breakable snap fit connection.

10. An item of merchandise and a merchandise hang tab comprising:

an item of merchandise;

a hang tab body that includes a hook portion and a base portion; the base portion being connected to the item of merchandise;

the hook portion being pivotably mounted to the base portion;

one of the hook and base portions including at least one locking tab with the other of the hook and base portions defining at least one locking recess;

the hook portion being retained in an extended position with respect to the base portion when the locking tab is received in the locking recess; and wherein the base portion of the hang tab body includes a finger that extends from the merchandise storage container; the hook portion including a pivot bar connected to the finger to pivotably connect the hook portion to the base portion.

11. The item of merchandise and a merchandise hang tab of claim 10, wherein the base portion of the hang tab body includes a flat mount connected to the item of merchandise.

12. The item of merchandise and a merchandise hang tab of claim 11, wherein the flat mount is disposed within the item of merchandise.

13. The item of merchandise and a merchandise hang tab of claim 10, wherein the item of merchandise includes a merchandise storage container and the base portion of the hang tab body has a mount disposed within the merchandise storage container.

14. The item of merchandise and a merchandise hang tab of claim 13, wherein the hook portion is substantially perpendicular to the mount when the hook portion is retained in the extended position.

15. An item of merchandise and a merchandise hang tab comprising:

an item of merchandise;

a hang tab body that includes a hook portion and a base portion; the base portion being connected to the item of merchandise;

the hook portion being pivotably mounted to the base portion;

one of the hook and base portions including at least one locking tab with the other of the hook and base portions defining at least one locking recess;

the hook portion being retained in an extended position with respect to the base portion when the locking tab is received in the locking recess; and wherein the base portion of the hang tab body includes a pair of spaced fingers that extend from the merchandise storage container; the hook portion including spaced pivot bars connected to the fingers to pivotably connect the hook portion to the base portion.

16. The item of merchandise and a merchandise hang tab of claim 15, wherein the locking tab and locking recess are disposed between the fingers.

17. The item of merchandise and merchandise hang tab of claim 10, wherein the locking tab is received in the locking recess in a makeable and breakable snap fit connection.

18. The item of merchandise and merchandise hang tab of claim 10, wherein the hang tab is removable from the item of merchandise.

19. An item of merchandise and a multiple-position merchandise hang tab comprising:

an item of merchandise and a merchandise storage container;

a hang tab body that includes a hook portion and a base portion; the base portion including a mount;

the base portion including a pivot element;

the base portion being connected to the item of merchandise with the mount at least partially disposed within the merchandise storage container;

the pivot element being disposed outside of the merchandise storage container;

the hook portion being pivotably mounted to the pivot element of the base portion;

one of the hook and base portions including at least one locking tab with the other of the hook and base portions defining at least one locking recess; and the hook portion being retained in a selected position with respect to the base portion when the locking tab is received in the locking recess.

20. The item of merchandise and a merchandise hang tab of claim 19, wherein the pivot element includes a pair of spaced fingers that extend from the merchandise storage container; the hook portion including spaced pivot bars connected to the fingers to pivotably connect the hook portion to the base portion.

21. The item of merchandise and a merchandise hang tab of claim 20, wherein the locking tab and locking recess are disposed between the fingers.

22. The item of merchandise and merchandise hang tab of claim 19, wherein the locking tab is received in the locking recess in a makeable and breakable snap fit connection.

23. The item of merchandise and merchandise hang tab of claim 19, wherein the hook portion is extended away from the merchandise storage container when the hook portion is in the selected position.

* * * * *